US006138829A

United States Patent [19]

Gidlund et al.

[11] Patent Number: 6,138,829

[45] Date of Patent: Oct. 31, 2000

[54] BEVERAGE CONTAINMENT DEVICE

[75] Inventors: Lasse Gidlund; Christian Beijer, both of Kvissleby, Sweden

[73] Assignee: Heavy Water Company, Salt Lake City, Utah

[21] Appl. No.: 09/456,121

[22] Filed: Dec. 7, 1999

[51] Int. Cl.[7] ..... B65D 23/00

[52] U.S. Cl. ..... 206/433; 215/355

[58] Field of Search ..... 206/427, 433, 206/541, 521; 215/234, 296, 355

[56] References Cited

U.S. PATENT DOCUMENTS

| | | | |
|---|---|---|---|
| 4,809,871 | 3/1989 | Angelchik | 215/355 |
| 4,826,029 | 5/1989 | Skoglie | 215/355 |
| 4,889,261 | 12/1989 | Conrad . | |
| 5,005,717 | 4/1991 | Oilar . | |
| 5,277,324 | 1/1994 | Cash . | |
| 5,282,541 | 2/1994 | Chen . | |
| 5,636,757 | 6/1997 | Porvaznik | 215/355 X |
| 5,727,709 | 3/1998 | Nobile . | |
| 5,758,789 | 6/1998 | Shin et al. . | |
| 5,857,580 | 1/1999 | Iikada . | |
| 5,868,272 | 2/1999 | Deal . | |
| 5,871,111 | 2/1999 | Pfefferkorn et al. . | |
| 5,873,478 | 2/1999 | Sullivan et al. . | |
| 5,897,010 | 4/1999 | Soyka, Jr. et al. . | |
| 5,897,037 | 4/1999 | Mann . | |

*Primary Examiner*—Jacob K. Ackun
*Attorney, Agent, or Firm*—John J. Skinner, Jr.; Edward J. Handler, III; Kenyon & Kenyon

[57] ABSTRACT

A device for the protection and containment of a distilled beverage is provided. The device has a heavy-gauge clear bottle, constructed of glass or plastic, with a bottle stopper which fits into a port hole cut through a top of the bottle. The bottle stopper is constructed having an easy-to-grip handle portion and a rod which extends through the port hole and into the containment portion of the bottle. A rubber ring is situated under a bottom portion of the handle and/or around the rod to provide a leak-proof seal between the port hole and rod so as to prevent spillage. Further, the bottle and bottle stopper fit into a durable transport case, constructed of an aluminum or heavy plastic material and having a linen or felt lining inside to ensure a snug fit of the bottle and bottle stopper into the case. To enable ease of access to the bottle and bottle stopper by a consumer or the like, the case can be further constructed having either a base portion and a cap which screws onto the base or two equal halves which are joined together at a hinge and have a latch on an opposite side of the case from the hinge which acts to securely fasten the case closed.

15 Claims, 6 Drawing Sheets

BEVERAGE CONTAINMENT DEVICE

FIELD OF THE INVENTION

The present invention relates to a beverage containment device, and more particularly, to the construction of a bottle, stopper and case for the protection and containment of a beverage product and which will allow for both the secure shipment of and ease of access to the product by a consumer or the like.

BACKGROUND DESCRIPTION OF THE ART

As long as mankind has been able to carry water or other beverages in flasks and bottles the problem of spillage and breakage has plagued those who would seek to carry or transport those flasks and bottles. In today's modern worldwide market, beverages are moved and transported around the world and in so being are often subjected to various extremes and excessive jostling. These inherent extremes and jostling often result in either spillage or breakage and thus a loss of the amount of the beverage product being transported to its end destination. For many beverage producers and their customers, this is an unacceptable situation. As such, many patents have issued in attempts to limit such losses while maintaining transportability.

For instance, one example is U.S. Pat. No. 4,889,261, issued Dec. 26, 1989 to Conrad, which relates to an assembly for the containment and dispensing of beverages. The assembly has a hollow body enclosing a chamber in which the beverage is contained. A port to the chamber, cut through the skin of the body of the assembly, and a removable closure means allow fluid communication between the chamber and outside. A further projection from the skin of the body of the assembly serves as a mount for a drinking vessel such as a cup. While adequate for containment of a beverage, the molding of the projection for the mounting of the drinking vessel takes up valuable containment volume as the chamber is indented to account for the area of the drinking vessel. As such, this may be inadequate for transportation and shipping purposes where maximizing volume is essential. Furthermore, the intricate molding of the projection may be difficult to achieve and may raise the cost of manufacturing the assembly.

While developing a device for the adequate protection and containment of a beverage has been problematic, another issue has been developing a cap to adequately allow access to the beverage once the device has reached its destination without disturbing the device's salient functions of protection and containment of the beverage. An example of an attempt to construct such a cap is U.S. Pat. No. 5,282,541, issued Feb. 1, 1994 to Chen, which relates to a cap locking device. The cap locking device has a dome-shaped bottle cap which threadably closes an inner bottle, a tubular post which extends down through the bottle cap and into the inner bottle, and a nipple through which the contained beverage can be accessed by pushing on a push button. Unfortunately, however, the construction of the push button and the device as a whole is made up of many different parts, some of which are movable, and thus all of which may be subject to improper assembly and breakage.

Another example is U.S. Pat. No. 5,277,324, issued Jan. 11, 1994 to Cash, which relates to a bottle cover which fits over a bottle cap and has a body cavity in which a fluid absorbing sponge material is placed. The absorbing sponge is so arranged as to absorb fluid which may overflow from the associated bottle during opening and thus acts to avoid spillage. Unfortunately, however, the beverage thus absorbed by the sponge is no longer utilizable by the consumer.

Thus, as can be seen, there remains a need for a device which allows adequate protection and containment of the beverage for shipping and transportation purposes while still also allowing easy access to the beverage by a consumer or such once the device has reached its destination.

SUMMARY OF THE INVENTION

Accordingly, the present invention provides a protective, non-breakable bottle with an easy-to-open leak-proof bottle stopper. For further protection and containment a bottle case into which the bottle and bottle stopper fit is provided.

The bottle itself is constructed to be cylindrical in shape with re-enforcing curved edges between the top/bottom and sides, has thick re-enforcing walls and has an inner chamber for containment of the beverage product. The bottle stopper is constructed having an easy-to-grip handle from which a rod depends and which fits into the bottle through an opening in the top of the bottle. Spillage from the bottle through the opening is prevented by the rod and/or by a rubber ring which fits below the handle and/or around the rod. Transport of the bottle and bottle stopper is enabled by a case which has an inside lining and into which the bottle and bottle stopper snugly fit. The case is solidly constructed in a cylindrical shape and allows ease of access by a consumer or the like by having a screw-on top which fits on a bottom piece or by having two equal halves which open up around a hinge and which has a latch on an opposite side of the hinge which acts to allow opening and securing of the case.

The present invention, including its features and advantages, will become more apparent from the following detailed description with reference to the accompanying drawings.

DETAILED DESCRIPTION

FIGS. 1 through 11 illustrate a device for the protection and containment of a beverage product, which device also allows for the secure shipment of and ease of access to the product by a consumer or the like.

Figure 1:
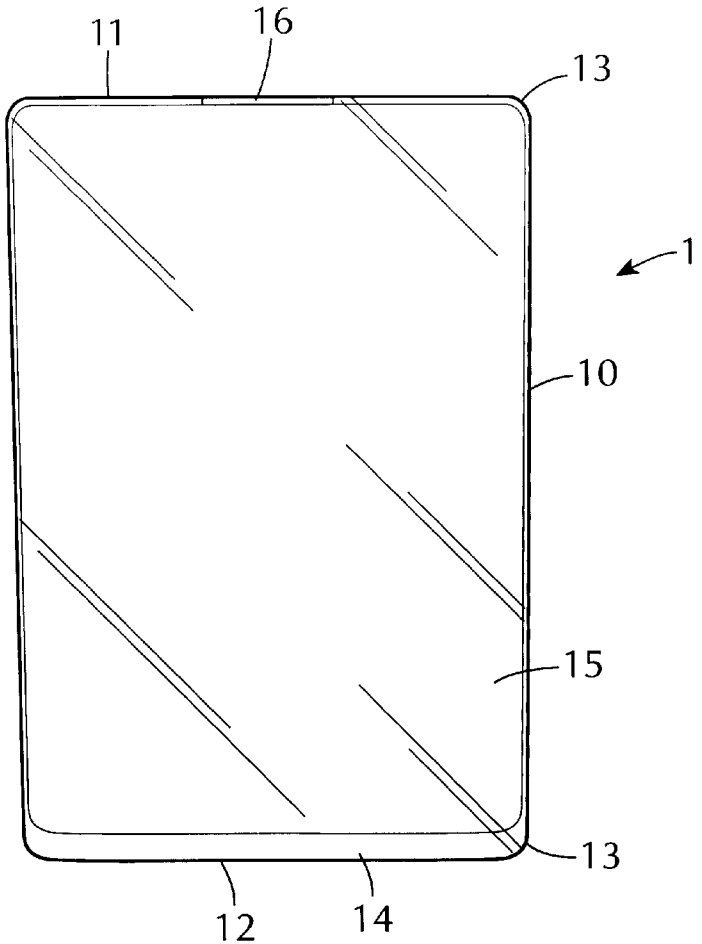
FIG. 1 illustrates a side view of a protective, non-breakable bottle rectangular in shape and having re-enforcing curved edges, according to an embodiment of the present invention.

Referring to FIG. 1, a bottle 1 is constructed of a clear, non-breakable plastic or glass in the shape of a cylinder having a continuous side wall 10, and a top 11 and a bottom 12 at each end closing off the cylindrically shaped side wall 10. A re-enforced rounded edge 13 integrally connects the side wall 10 to the top 11 and to the bottom 12 at the respective junctures. Preferably, the bottle 1 is 138 mm in height and 93 mm wide in diameter. The side wall 10, top 11 and bottom 12 of bottle 1 are buttressed by an added re-enforcing thickness 14. Such re-enforcing thickness 14 enhances the bottles non-breakability and aids in ensuring safe transport of the beverage product (not shown). Preferably, the bottle 1 is 1 to 2 mm in thickness.

Bottle 1 further comprises a containment chamber 15, formed by the surrounding re-enforcing thickness 14 and respective side wall 10, top 11 and bottom 12, which allows safe storage and containment of the beverage product. Preferably, the containment chamber 15 can safely store and contain 700 ml of the beverage product. A port hole 16, cut through the center of top 11, allows access to the beverage. The port hole 16 is cut circumferentially around a center point of top 11, and preferably is 25 mm in diameter.

Figure 2:
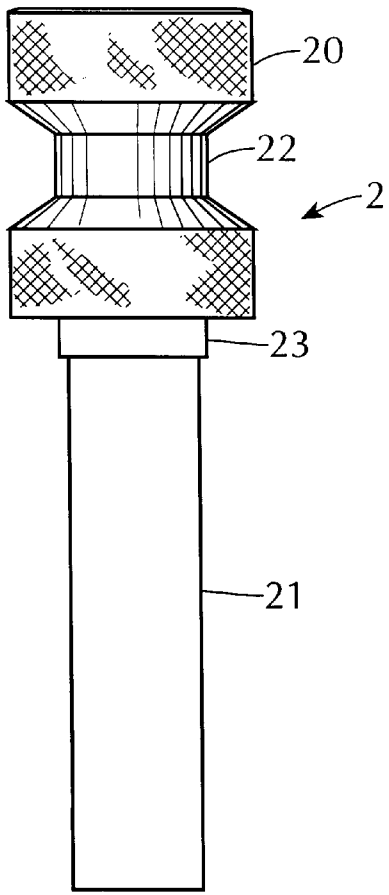
FIG. 2 illustrates a side view of a bottle stopper having a leak-proof sealer constructed around the rod portion, according to an embodiment of the present invention.
Figure 4:
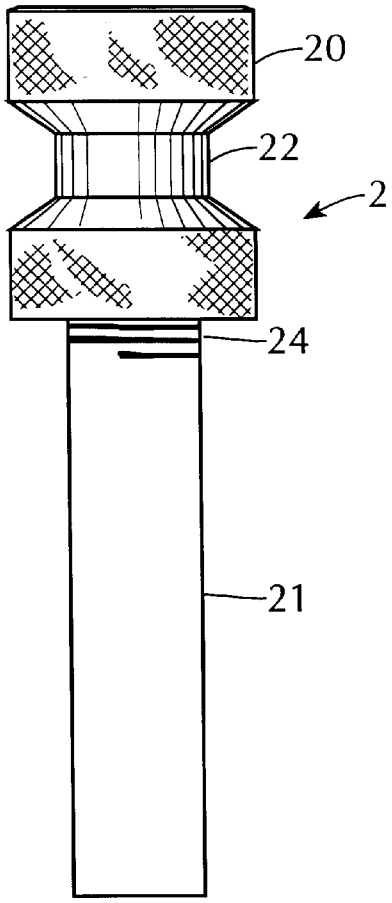
FIG. 4 illustrates a side view of a bottle stopper having a screw thread with which the stopper can be screwed onto the bottle, according to an embodiment of the present invention.
Figure 3:
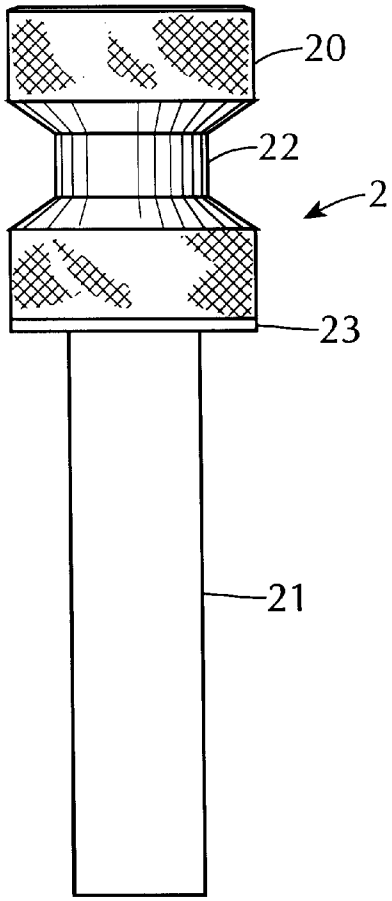
FIG. 3 illustrates a side view of a bottle stopper having a leak-proof sealer constructed under the handle portion, according to an embodiment of the present invention.

Referring now to FIGS. 2, 3 and 4, a stopper 2 is constructed of an aluminum or other light metal and comprises an easy-to-grip handle 20 and an elongated rod 21. The easy-to-grip handle 20 may be shaped such that its circumference is circular or otherwise. For instance, in an alternative embodiment the handle 20 may take the shape of a square, rectangle, triangle or even a five-sided pentagon. Preferably, the handle 20 is circular is shape and has a diameter of 40 mm. The outer face of the circumference of the handle 20 may also be serrated in some fashion to aid in gripping and manipulation of the stopper 2. Further, the handle 20 has an indented grasping area 22 to also allow easier gripping and manipulation of the stopper 2 so that the stopper 2 may be placed on or removed from the bottle 1. Preferably, handle 20 is 53 mm in overall length, with the indented grasping area 22 centered between the two ends of the handle 20 and having two sloping sides which angle towards the center indentation. Also preferably, the indented area 22 indents 7.5 mm from the outside edge of the handle 20 and is 13 mm in length (exclusive of the two sloping sides). Integrally connected to and depending from the handle 20 is the elongated rod 21. The rod 21 is designed to fit through the port hole 16 of the bottle 1 and hang into the containment chamber 15. Preferably, the rod 21 is constructed so that it is 25 mm in circumference, 108 mm in length and 1 pound in weight. Thus, preferably, the stopper 2 is 161 mm in overall length.

To prevent spillage of the beverage from the containment chamber 15 through the port hole 16 of bottle 1 while the stopper 2 is in place, either a rubber ring 23 or an encircling thread 24 may be utilized on the stopper 2. As shown in FIGS. 2 and 3, if a rubber ring 23 is utilized, the ring 23 is positioned such that it forms a continuous band around the elongated rod 23 with either an edge or side of the ring flush with the bottom of the handle 20 and such that the surface of the ring 23 comes into contact with an edge of the port hole 16. Alternatively, as shown in FIG. 4, an encircling thread 24 may be etched onto or into the elongated rod 21 from a point flush with the bottom of the handle 20 to a point somewhere along the rod and such that the thread 24 engages an edge of the port hole 16. It is to be understood, of course, that the different embodiments to prevent spillage may be utilized either alone or in conjunction with one another. For instance, two of the rubber rings 23 may be utilized, one in each position as described above, or a single ring 23 flush to the bottom of the handle 20 may be utilized with the thread 24 around the rod 21.

Figure 6:
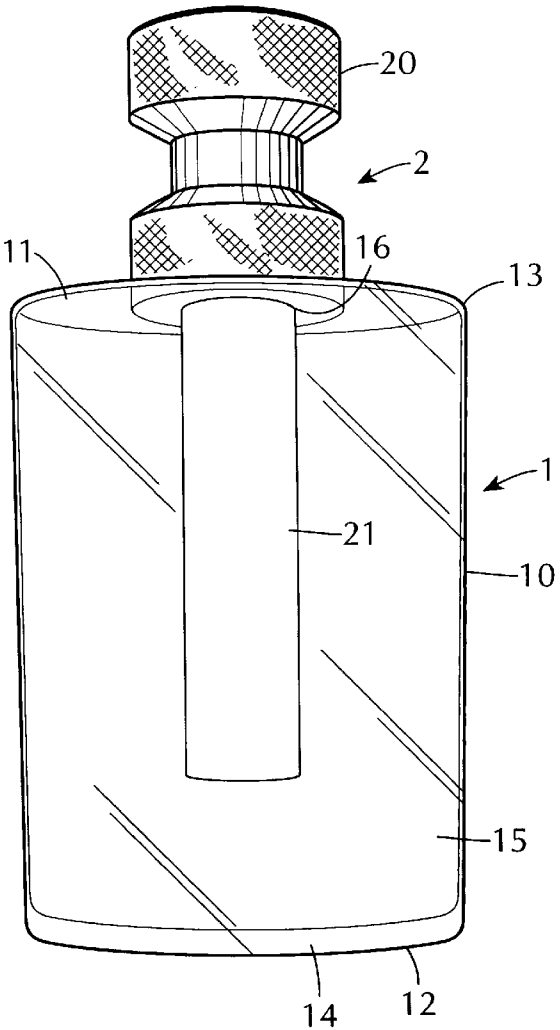
FIG. 6 illustrates an isometric side view from a viewing point slightly below the top of the bottle and stopper of FIG. 5, according to an embodiment of the present invention.
Figure 5:
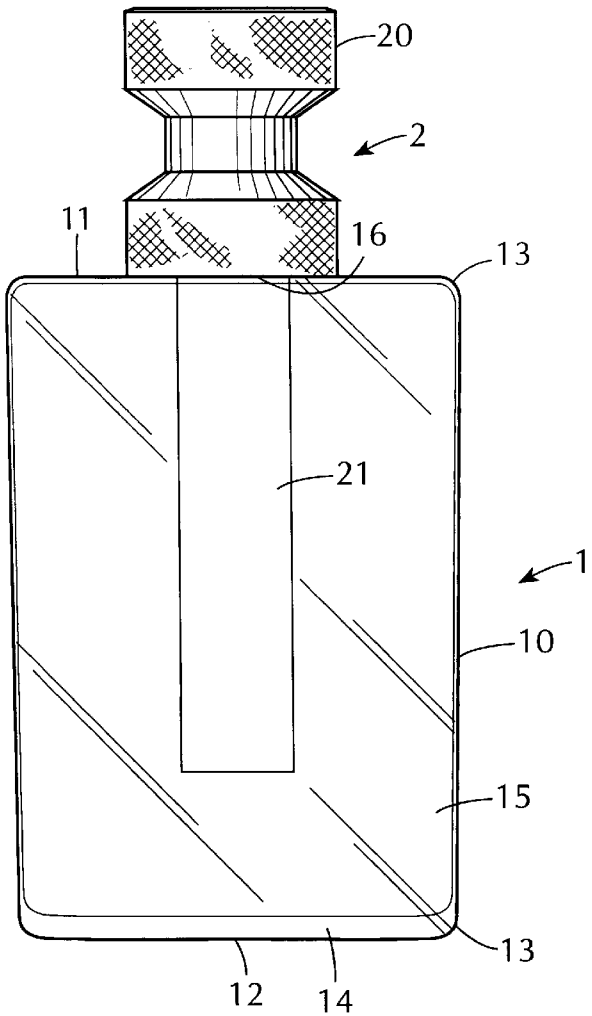
FIG. 5 illustrates a side view of the bottle of FIG. 1 with the stopper of either FIGS. 2, 3 or 4 in place, according to an embodiment of the present invention.
Figure 7:
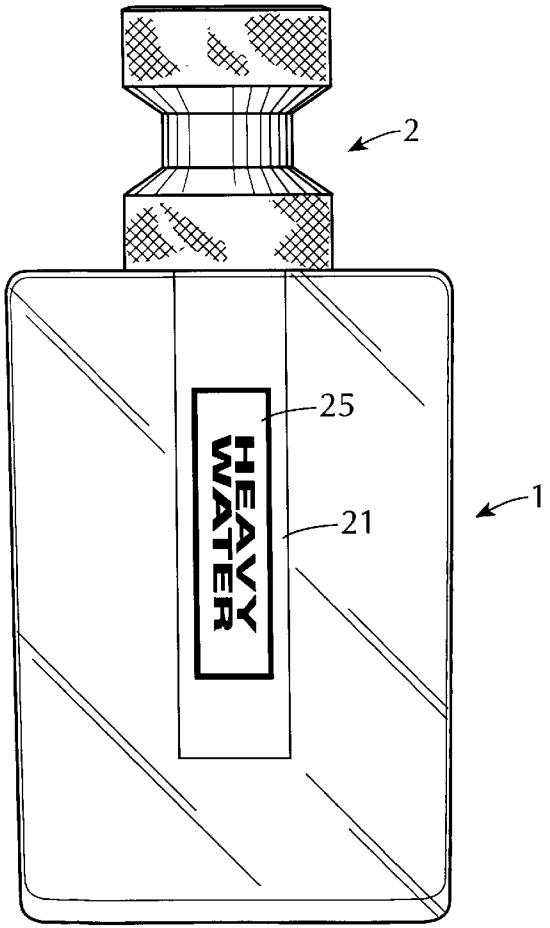
FIG. 7 illustrates a side view of a possible advertising feature shown along the length of the rod of the stopper while the stopper is in place on the bottle, according to an embodiment of the present invention.

Referring now to FIGS. 5, 6 and 7, the stopper 2 in place on the bottle 1 is shown. When properly placed the elongated rod 21 of the stopper 2 fits into the port hole 16 cut through the top 11 of bottle 1 such that the entire length of the rod 21 is inserted into the containment chamber 15. When so fully inserted, the bottom of the handle 20 is flush with and resides upon an outer surface of the top 11 of the bottle 1. In this manner then, when the entire length of the elongated rod 21 of the stopper 2 resides in the containment chamber 15 of the bottle 1, the stopper 2 is secure on the bottle 1 as a result of the length and weight of the rod 21. In addition, either the rubber ring 23 and/or the encircling thread 24 may help in securing the stopper 2 on the bottle 1 in that both the rubber ring 23 and the thread 24, in providing a leak-proof seal, provide resistance to removal of the stopper 2 from the bottle 1. The rubber ring 23, when positioned such that its width is along the length of the rod 21 and its edge flush against the bottom of the handle 20 as shown in FIG. 2, fits snugly into the port hole 16. The snug fit between the surface of the rubber ring 23 and an inside edge of the port hole 16 creates friction which, in addition to the length and weight of the rod 21, prevents the stopper 2 from easily disengaging from the bottle 1. Alternatively, the engagement of the thread 24 with the inside edge of the port hole 16 requires that the stopper 2 be screwed and unscrewed from the bottle 1, as the stopper 2 can only be properly placed onto and removed from the bottle 1 by this screwing motion when the thread 24 has been etched onto or into the rod 21.

As the bottle 1 is constructed of a clear see-through material, such that the elongated rod 21 of the stopper 2 is clearly visible through the bottle 1, it is possible to place an advertisement 25 or the like upon the length of the rod 21, as shown in FIG. 7. Advertisement 25 or the like can be a product label and/or list of ingredients, instructions, recipes, warnings, etc. For example, the trademark HEAVY WATER, identifying the brand of the distilled beverage, can be shown along the length of the rod 21.

Figure 8:
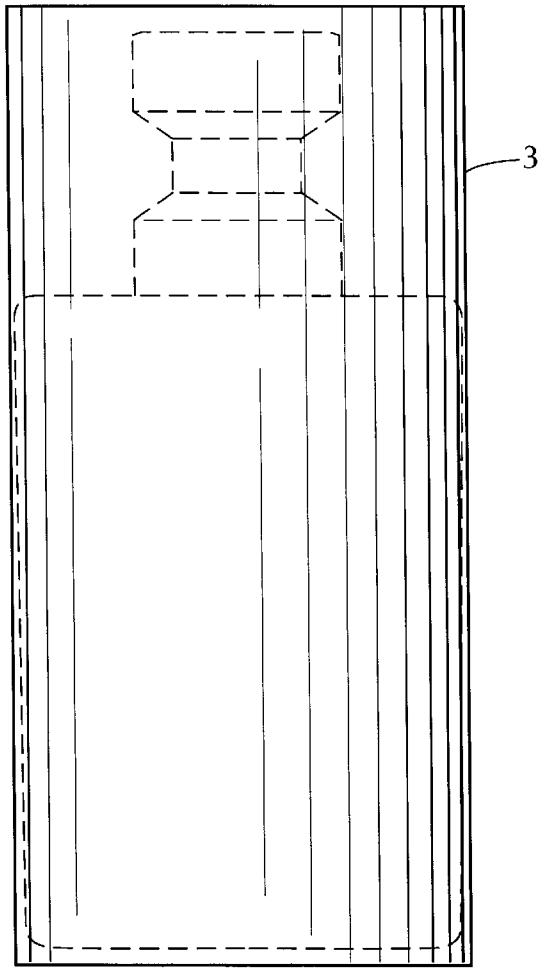
FIG. 8 illustrates a side view of a cylindrical bottle case into which the bottle and stopper fit (as shown by the dotted line), according to an embodiment of the present invention.
Figure 10:
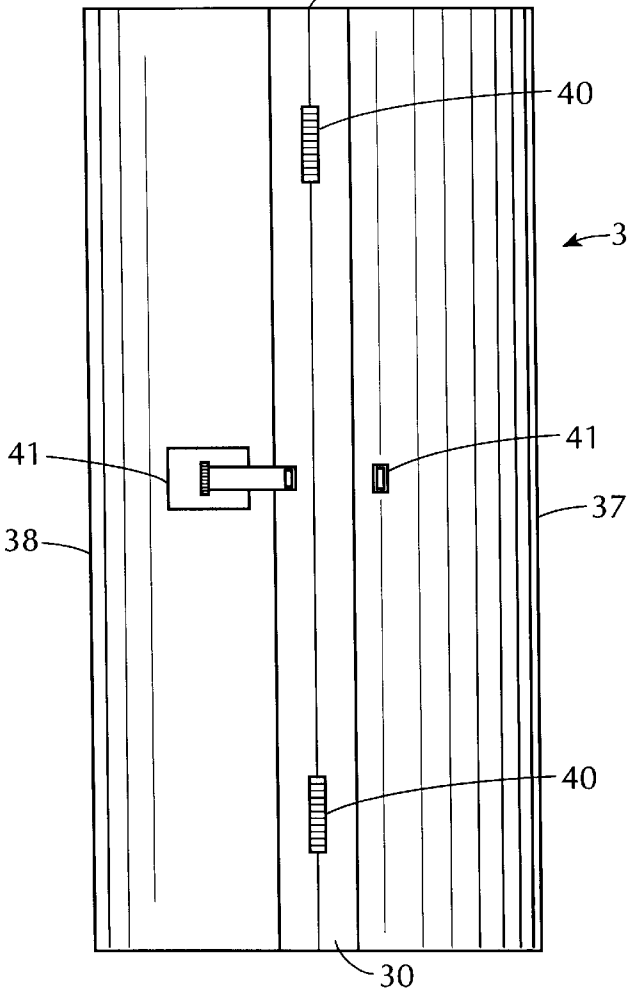
FIG. 10 illustrates a side view of the bottle case of FIG. 8 having two equal halves which swing away from each other around a hinge, according to an embodiment of the present invention.
Figure 9:
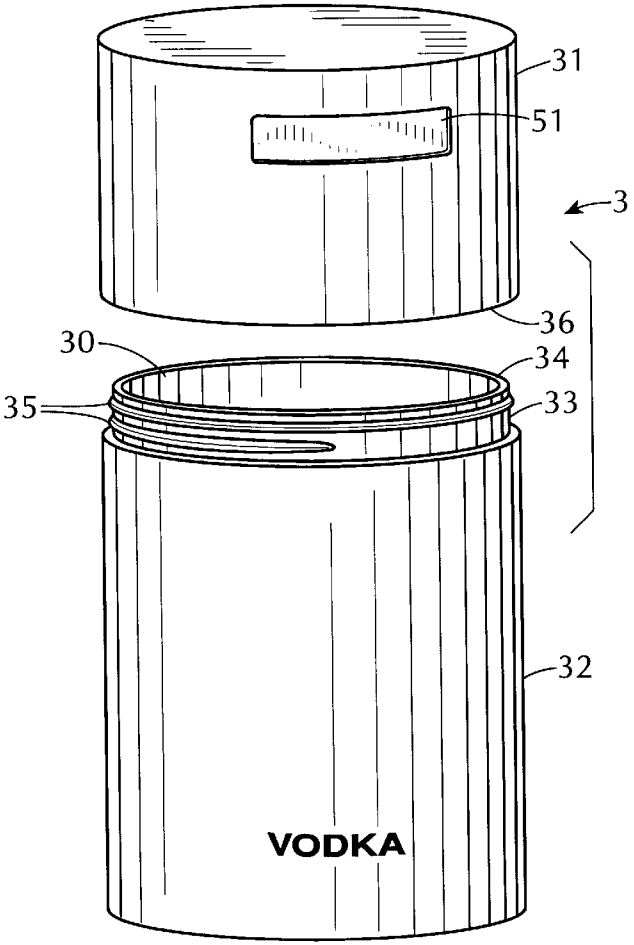
FIG. 9 illustrates an isometric side view of the bottle case of FIG. 8, from a viewing point slightly above the top of the case, having a top portion which screws onto a bottom portion, according to an embodiment of the present invention.

Referring now to FIGS. 8, 9 and 10, a protective outer case 3 into which the bottle 1 and stopper 2 fit is shown. The case 3 is constructed of an aluminum or other light metal, has a cylindrically shaped wall surrounding a hollow chamber inside, and a top and bottom which close off each end respectively. Preferably, the outer measurement of the case is 199 mm in height and 101 mm in diameter, while the walls of the case have a thickness of 6 mm. Inside of the case 3, on an inside wall, a linen or felt lining 30 may be positioned. The lining 30 helps to cushion the bottle 1 and stopper 2, ensuring a snug fit and thereby preventing excessive movement of the bottle 1 and stopper 2 inside the case 3. Preferably, the lining is 1 to 2 mm thick. The positioning of the bottle 1 and stopper 2 inside the case 3 is shown by the dotted line in FIG. 8.

For ease of access to the bottle 1 and stopper 2 by a consumer or the like, the case 3 may be constructed of a top piece 31 and a bottom piece 32, as shown in FIG. 9. The bottom piece 32 has a slight indentation 33 in the outer surface located around its upper lip 34, thereby providing room for a thread 35. A similar cooperative indentation (not shown) is found on an inside surface of a lower lip 36 of the top piece 31, thus also providing room for a cooperative thread (not shown) which can engage with thread 35 on the bottom piece 32. Thus, in this embodiment of the case 3, the case can be opened and closed by screwing the top 31 onto and off of the bottom 32 by an engagement of the cooperatively designed threads on each of the respective top and bottom pieces. In this embodiment, the top piece 31 is preferably 77 mm in length, the bottom piece 32 is 137 mm in length, while the overlap between the two pieces for the thread is 15 mm in length.

Alternatively, and also for ease of access to the bottle 1 and stopper 2 by a consumer or the like, the case 3 may be constructed of two equal halves 37 and 38, as shown in FIG. 10. In other words, the case 3 is split down the middle lengthwise. The two halves are joined to one another on one side by at least one hinge 40, and thus open around a pivot point 39 on a hinge axis. On the opposite side of the hinge(s) 40 on each of the halves 37 and 38, a latch 41 is constructed. Thus, in this embodiment of case 3, the case can be opened and closed by engaging and disengaging the latch 41 and swinging the case open and shut around the hinge 40. It is to be understood, of course, that the hinge axis may be either vertical or horizontal. In other words, the hinge may be placed along the side wall of the case or on the top or bottom of the case, with the latch, of course, placed oppositely on a outer surface of the case.

Figure 11:
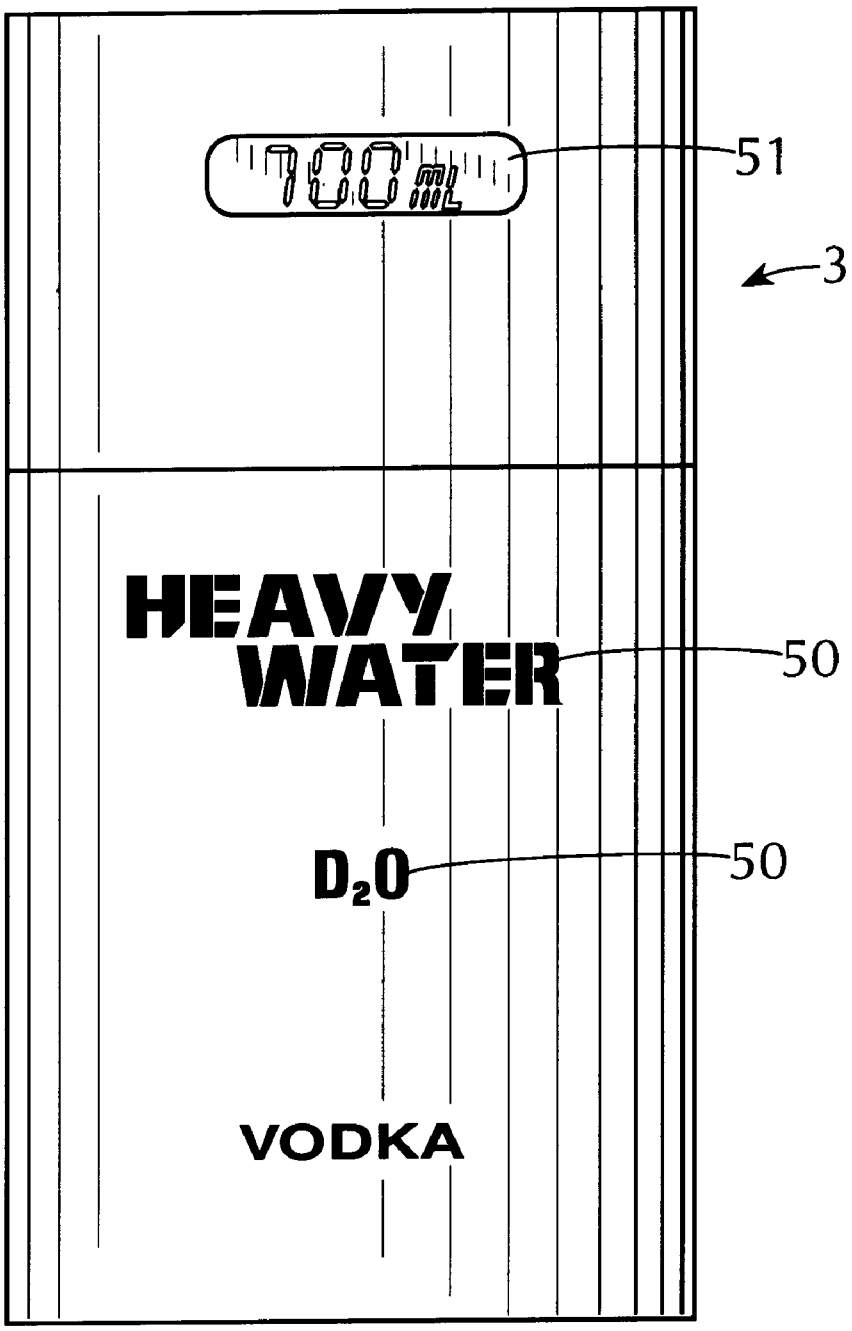
FIG. 11 illustrates a side view of the bottle case of FIG. 8 showing a possible advertising feature on the outside wall of the case, according to an embodiment of the present invention.

Referring now to FIG. 11, in either embodiment of the case construction as shown in FIGS. 9 and 10, an advertisement 50 or the like can be placed on the outside surface of the case 3. Once again, advertisement 25 or the like can be a product label, warning label, list of ingredients, instructions, recipes, etc. For example, the trademarks HEAVY WATER and $D_2O$ can be placed to identify the brand name and beverage product contained within the case. Further, an indentation 51 in the outer surface of the case 3 can be cut-out so as to decoratively contain the volume total of the beverage product or the like.

Thus, as can be seen from the foregoing description, the device of the present invention provides for both the protection and containment of a beverage product and for the secure shipment of and ease of access to the product by a consumer or the like, all while being aesthetically pleasing to the eye. Furthermore, the construction of the device allows for highly visible placement of advertising or the like onto the device and thus easy identification of the product.

In the foregoing description, the beverage containment device of the present invention has been described with reference to a number of examples that are not to be considered limiting. Rather, it is to be understood and expected that variations in the principles of the device herein disclosed may be made by one skilled in the art and it is intended that such modifications, changes, and/or substitutions are to be included within the scope of the present invention as set forth in the appended claims. The specification and the drawings are accordingly to be regarded in an illustrative rather than in a restrictive sense.

What is claimed is:

1. A beverage containment device, comprising:

a bottle, comprising:

a cylindrically-shaped continuous side wall;

a top and a bottom integrally connected at each respective end of the cylindrically shaped continuous side wall;

a containment chamber, in which a beverage may be stored, formed by the side wall, top and bottom; and a port hole cut through a center point of the top and by which the beverage may be accessed; and a stopper, comprising:

an easy-to-grip handle having an indented grasping area; and an elongated rod integrally connected to and depending from the handle, wherein containment of the beverage is achieved when the elongated rod of the stopper is fully inserted into the port hole cut through the top of the bottle and when a bottom surface of the handle rests on an outer surface of the top of the bottle.

2. The beverage containment device of claim 1, wherein the bottle further comprises:

a re-enforcing rounded edge at each of the respective integral connections between the top and bottom and the side wall.

3. The beverage containment device of claim 1, wherein the bottle further comprises:

a re-enforcing thickness which buttresses the side wall, top and bottom.

4. The beverage containment device of claim 1, wherein the stopper further comprises:

a rubber ring which encircles the elongated rod of the stopper.

5. The beverage containment device of claim 1, wherein the stopper further comprises:

a thread which encircles the elongated rod of the stopper at a point flush with the bottom surface of the handle to a point distant along the rod.

6. The beverage containment device of claim 1, further comprising:

a protective outer case, comprising:

a cylindrically-shaped side wall;

a top and a bottom integrally connected at each respective end of the cylindrically shaped side wall;

a hollow chamber formed by the side wall, top and bottom; and a lining positioned on an inside surface of each of the side wall, top and bottom, wherein the bottle and stopper snugly fit into the hollow chamber of the case, and wherein the case can be constructed in two pieces so that the bottle and stopper can be easily accessed.

7. The beverage containment device of claim 6, wherein the two pieces of the case are split along a horizontal axis of the case and comprise:

a bottom piece having a slight indentation in an outer surface located around an upper lip and a thread encircling the indentation; and a top piece having a slight indentation in an inner surface located around a lower lip and a thread encircling the indentation, wherein the slight indentations and the threads of both the top and bottom pieces are cooperative with one another such that the top piece may be placed onto or removed from the bottom piece by a screwing motion.

8. The beverage containment device of claim 6, wherein the two pieces of the case are split along a vertical axis of the case and comprise:

a first halve;

a second halve;

at least one hinge which acts to join the first halve and the second halve together along a hinge axis; and a latch, placed on an opposite outer side of the case from the hinge axis, wherein the first and second halves of the case may be opened and closed by swinging the two halves around the hinge axis and engaging or disengaging the latch.

9. The beverage containment device of claim 1, wherein at least one of a product label, list of ingredients, instructions, recipes, warning label, advertisement and trademark is placed on the elongated rod.

10. The beverage containment device of claim 6, wherein at least one of a product label, list of ingredients, instructions, recipes, warning label, advertisement and trademark is placed on the case.

11. The beverage containment device of claim 6, wherein the case further comprises:

a cut-out on an outer surface of the case in which a label can be positioned.

12. The beverage containment device of claim 1, wherein the easy-to-grip handle has at least one outer surface which is serrated.

13. The beverage containment device of claim 1, wherein the bottle is constructed of one of plastic and glass.

14. The beverage containment device of claim 1, wherein the stopper is constructed of aluminum.

15. The beverage containment device of claim 6, wherein the case is constructed of aluminum.

* * * * *